US008678188B2

(12) United States Patent
Larsen

(10) Patent No.: US 8,678,188 B2
(45) Date of Patent: Mar. 25, 2014

(54) APPARATUS AND METHOD FOR STORING THINGS

(76) Inventor: Helen D. Larsen, Sandy, UT (US)

( * ) Notice: Subject to any disclaimer, the term of this patent is extended or adjusted under 35 U.S.C. 154(b) by 58 days.

(21) Appl. No.: 13/168,945

(22) Filed: Jun. 25, 2011

(65) Prior Publication Data

US 2012/0325718 A1 Dec. 27, 2012

(51) Int. Cl.
*B65D 21/00* (2006.01)
*B65D 21/02* (2006.01)

(52) U.S. Cl.
USPC ..... 206/504; 206/503; 206/509; 206/511; 220/4.26; 220/4.27; 220/23.2; 220/23.6

(58) Field of Classification Search
USPC ..... 220/4.26, 4.27, 23.2, 23.6, 23.83; 206/503, 504, 509, 511
See application file for complete search history.

(56) References Cited

U.S. PATENT DOCUMENTS

| | | | | |
|---|---|---|---|---|
| 5,002,199 | A * | 3/1991 | Frahm | 220/670 |
| 5,862,941 | A * | 1/1999 | Jones | 220/772 |
| D464,887 | S * | 10/2002 | Sherwell | D9/516 |
| 2004/0116037 | A1* | 6/2004 | Garpow | 446/74 |
| 2009/0090647 | A1* | 4/2009 | Panchal et al. | 206/504 |

* cited by examiner

*Primary Examiner* — Anthony Stashick
*Assistant Examiner* — Madison L Poos
(74) *Attorney, Agent, or Firm* — Wright Law Group, PLLC; Mark F. Wright

(57) ABSTRACT

The present invention comprises a storage container that comprises a front panel, a back or rear panel, a left side panel, a top portion, and a bottom portion. Each of the panels, as well as the top portion and the bottom portion of the storage container, comprises a contact surface with each contact surface comprising at least one contact point. The use of multiple contact surfaces and multiple contact points allows a plurality of storage containers to be efficiently and securely stacked and nested, thereby allowing for quick and easy storage of items while conserving valuable yet precious storage space.

18 Claims, 5 Drawing Sheets

APPARATUS AND METHOD FOR STORING THINGS

BACKGROUND OF THE INVENTION

1. Technical Field

The present invention relates generally to storage containers and more specifically relates to the storage of perishable items including foods and liquids as well as nonperishable items.

2. Background Art

The practice of storing foods, liquids, and nonperishables is common in both homes and many commercial industries. In many cases, the storage of foods and liquids is part of a program of preparation for a natural disaster. With adequate storage in place, people will be able to consume the stored food and liquid should the need arise. Alternatively, consumers may store beads, coins, batteries or other nonedible products or materials for emergencies or simply to have some extra items on hand for the sake of convenience. While storing various items is a well-known practice, there are certain impediments that may prove somewhat challenging when implementing a desired storage regime.

For example, besides the cost of purchasing foods, liquids, and nonperishable items, individuals often face limited storage space. Individuals that live in an urban area often reside in apartments where storage space is at a premium. In response, individuals often place storage containers in closets, on shelves, or under or behind furniture. However, commonly used containers include metal cans, glass bottles, plastic storage containers, and the like are not always adaptable to these storage conditions. In some situations, when the cans, bottles or plastic storage containers are stacked on top of each other, they can be unstable and dangerous. Additionally, many people do not have adequate storage space because they simply don't have room in their apartment or home to stack boxes and metal cans. Accordingly, without additional improvements in the state of the art for storing items, the results for storing items will continue to be suboptimal.

BRIEF SUMMARY OF THE INVENTION

The present invention comprises a storage container that comprises a front panel, a back or rear panel, a left side panel, a top portion, and a bottom portion. Each of the panels, as well as the top portion and the bottom portion of the storage container, comprise a contact surface with each contact surface comprising at least one contact point. The use of multiple contact surfaces and multiple contact points allows a plurality of storage containers to be efficiently and securely stacked and nested, thereby allowing for quick and easy storage of items while conserving valuable yet precious storage space.

BRIEF DESCRIPTION OF THE FIGURES

The preferred embodiments of the present invention will hereinafter be described in conjunction with the appended drawings, wherein like designations denote like elements, and.

DETAILED DESCRIPTION

Figure 1:
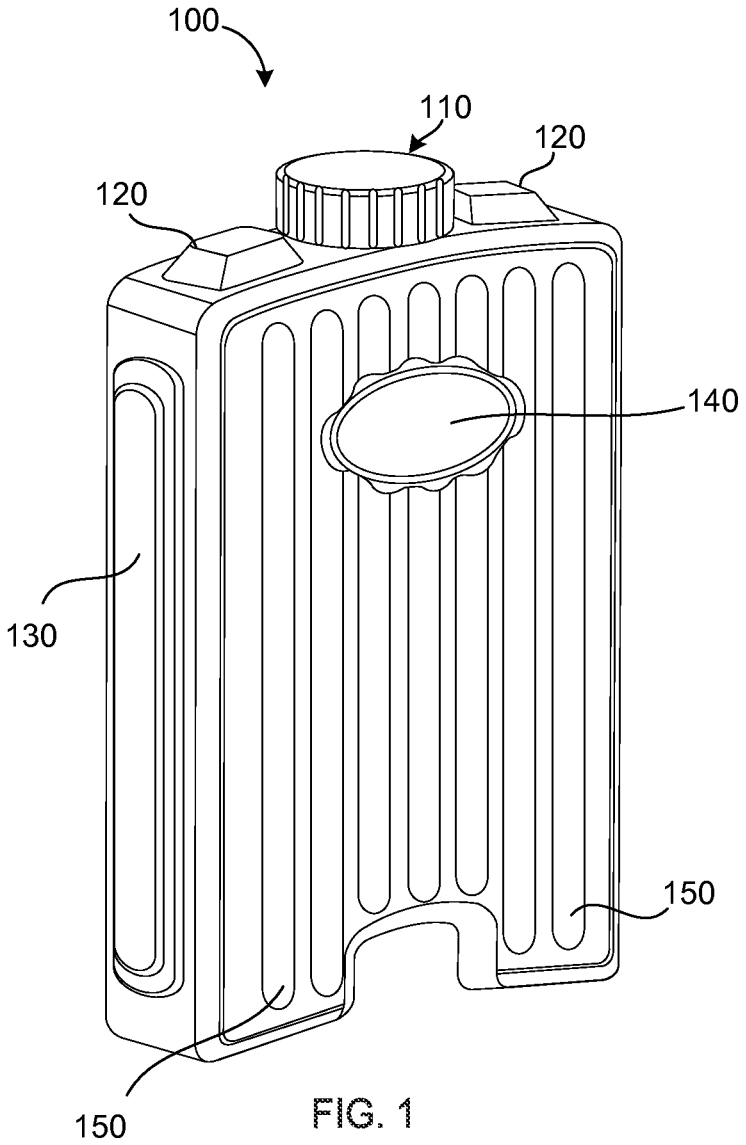
FIG. 1 is a perspective view of a storage container in accordance with a preferred exemplary embodiment of the present invention.

The present invention comprises a storage container that comprises a front panel, a back or rear panel, a right side panel, a left side panel, a top portion, and a bottom portion. Each of the panels, as well as the top portion and the bottom portion of the storage container, comprises a contact surface with each contact surface comprising at least one contact point. The use of multiple contact surfaces and multiple contact points allows a plurality of storage containers to be efficiently and securely stacked and nested, thereby allowing for quick and easy storage of items while conserving valuable yet precious storage space.

The most preferred embodiments of the present invention are manufactured from a plastic material where the plastic is an opaque or semi-opaque food-grade plastic. Opaqueness is a desired feature for at least some preferred embodiments of the present invention because opaque material blocks can reduce or eliminate the effects of sunlight on the materials stored in the interior space of the storage container and decreases the rate at which bacteria will grow inside the container. In at least one preferred embodiment of the present invention, the walls of the container are opaque and beige or white so that they will blend in with the color of a typical wall in a home.

There are a plurality of food grade plastics that may be suitable for use in the various preferred embodiments of the present invention, including (but not limited to) the following exemplary materials.

PET or PETE (polyethylene terephthalate) is a clear, tough polymer with exceptional gas and moisture barrier properties. PET's ability to contain carbon dioxide (carbonation) makes it ideal for use in soft drink bottles. Examples: Soft drink bottles, detergent bottles.

HDPE (high density polyethylene) is typically used in milk, juice and water containers in order to take advantage of its excellent protective barrier properties. Its chemical resistance properties also make it well suited for items such as containers for household chemicals and detergents. Most five gallon food buckets are made from HDPE. Examples: Milk bottles, shopping bags.

Vinyl (polyvinyl chloride, or PVC) provides excellent clarity, puncture resistance and cling. As a film, vinyl can breathe just the right amount, making it ideal for packaging fresh meats that require oxygen to ensure a bright red surface while maintaining an acceptable shelf life. Examples: Plastic food wrap, shrink-wrap, garden hoses, shoe soles.

LDPE (low density polyethylene) offers clarity and flexibility. It is used to make bottles that require flexibility. To take advantage of its strength and toughness in film form, it is used to produce grocery bags and garbage bags, shrink and stretch film, and coating for milk cartons. Examples: Squeeze bottles, dry cleaning bags.

PP (polypropylene) has high tensile strength, making it ideal for use in caps and lids that have to hold tightly on to threaded openings. Because of its high melting point, polypropylene can be hot-filled with products designed to cool in bottles, including ketchup and syrup. It is also used for products that need to be incubated, such as yogurt. Various food storage containers are made from PP. Examples: Bottle caps, take-out food containers, drinking straws.

PS (polystyrene), in its crystalline form, is a colorless plastic that can be clear and hard. It can also be foamed to provide exceptional insulation properties. Foamed or expanded polystyrene (EPS) is used for products such as meat trays, egg cartons and coffee cups. It is also used for packaging and protecting appliances, electronics and other sensitive products. Examples: Plastic foam, packing peanuts, coat hangers.

The exact composition of the materials used to manufacture the storage containers of the present invention will be selected based on the type of material to be stored inside the storage container. In the most preferred embodiments of the present invention, the cap will be manufactured from polypropylene and the storage container will be manufactured from high-density polyethylene. In other preferred embodiments of the present invention, materials other than food grade plastic may be utilized. These other materials include fiberglass, metal, etc. For the food grade plastic embodiment of the present invention, a typical blow mold process can be used to manufacture storage container 100. For other materials, those skilled in the art will recognize that the standard manufacturing techniques used to manufacture storage containers 100 from alternate materials.

Referring now to FIG. 1 a perspective view of a storage container 100 in accordance with a preferred embodiment of the present invention is shown. As shown in FIG. 1, storage container 100 comprises a substantially rectangular parallelepiped or cuboid body, having gently rounded corners and edges, and a cap 110 positioned over an opening or spout that provides access to the interior space of storage container 100.

In the most preferred embodiments of the present invention, cap 110 is an internally threaded cap that is removably attached to and removed from the body of storage container 100 by rotating cap 100 in the appropriate direction (e.g., clockwise or counterclockwise) to tighten or loosen cap 110 relative to the body of storage container 100. In the most preferred embodiments of the present invention, each storage container 100 is formed with an externally threaded neck or spout in the top portion of storage container 100 and a seal, grommet, gasket or washer is removably inserted in cap 110 so that liquids or semi-solid materials can be successfully contained with the interior space of each storage container 100, if desired. The seal or gasket provides a way to keep external moisture and air from entering the interior space of storage container 100 and to keep the contents of each storage container 100 relatively isolated from the surrounding environment. The use of a threaded neck or spout, along with a threaded cap and gasket is well known to those skilled in the art.

As shown in FIG. 1, the most preferred embodiments of storage container 100 comprises a pair of top surface contact points 120, formed in the top portion of the body of storage container 100. Contact points 120 act as "contact surfaces" where a contact surface formed in a panel or portion of the body of a first storage container 100 is placed in contact with the contact surface of another panel or portion of the body of a second storage container 100. In the most preferred embodiments of the present invention, top surface contact points 120 comprise a right square prism or some other frusto-pyramidal shape. Top surface contact points 120 are sized and positioned so as to be insertable into cooperating and coordinating indentations, depressions or recesses formed in the bottom portion of storage container 100 (not shown this FIG.). Thus it can be seen that the top portion and the bottom portion of the body of storage container 100 contain a plurality of contact surfaces.

Similar to top contact points 120, left side contact surface or contact point 130 is formed in the body of storage container 100. In most preferred embodiments of the present invention, left side contact surface or point 130 comprises a rounded right square prism or similar frusto-pyramidal shape. Contact point 130 protrudes from the left side panel of side contact point 130 and is a substantially vertical contact point, designed to be inserted into a cooperating indentation, depression or recess formed in the right side panel of a second side storage container 100 (not shown this FIG.) and act as a contact surface.

Optional branding surface 140 is provided in certain preferred embodiments of the present invention to allow for the inclusion of various trademarks, slogans, logos, or other indicia, if desired. In the most preferred embodiments of the present invention, branding surface 140 has an oval shape and interrupts the continuity of ribs 150 on front panel and/or back panel of storage container 100.

On each of the front panel and the back panel of storage container 100, a series of rounded protrusions or "ribs" 150 are formed in the body of storage container 100. As shown in FIG. 1, ribs 150 comprise a series of substantially vertical parallel protrusions that extend from near the top of the front panel (e.g., near the top portion of storage container 100) to a position near the bottom of the front panel (e.g., near the bottom portion of storage container 100). It is important to note that, in the most preferred embodiments of the present invention, there is an odd number of ribs 150 on the front panel of storage container 100 (e.g., 7 ribs 150) and an even number of ribs 150 on the back panel of storage container 100 (e.g., 6 or 8 ribs 150) or vice versa as to even and odd on front or back. This forms a wavy or corrugated surface for both the front panel and the back panel of storage container 100.

Figure 2:
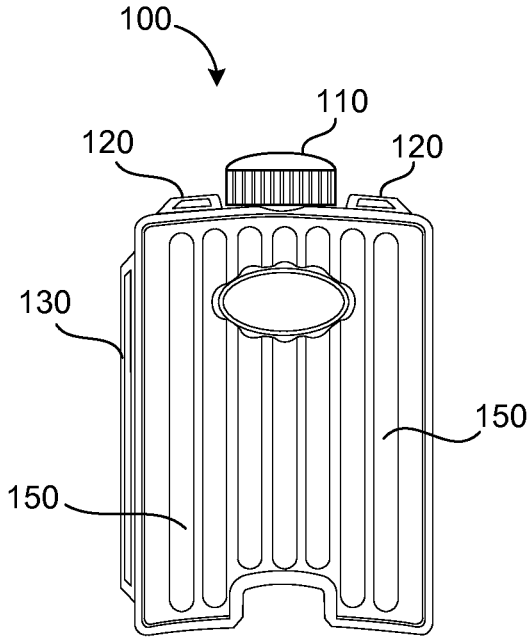
FIG. 2 is a front view of a storage container, and associated front panel, in accordance with a preferred exemplary embodiment of the present invention.

Referring now to FIG. 2 a front view of a storage container 100, also depicting the front panel of storage container 100, in accordance with a preferred embodiment of the present invention is shown. As shown in FIG. 2, storage container 100

Figure 3:
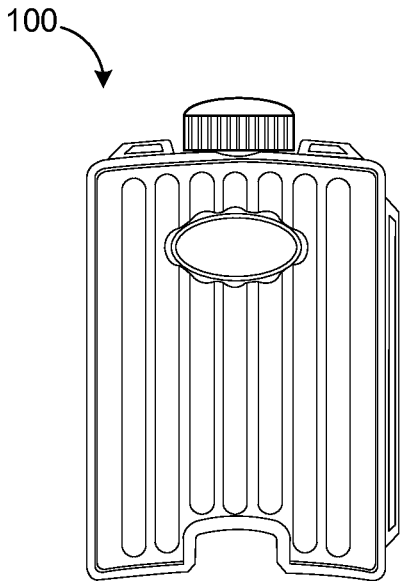
FIG. 3 is a rear view of a storage container, and associated back or rear panel, in accordance with a preferred exemplary embodiment of the present invention.

Referring now to FIG. 3 a rear view of a storage container 100, also depicting the back panel of storage container 100, in accordance with a preferred embodiment of the present invention is shown. As shown in FIG. 3, the back panel of storage container 100 comprises a plurality of ribs 150, in similar orientation as ribs 150 formed in the front panel of storage container 100. However, as mentioned elsewhere, the number of ribs 150 on the back panel of storage container 100 is either one greater or one less than the number of ribs 150 on the front panel of storage container 100.

Figure 4:
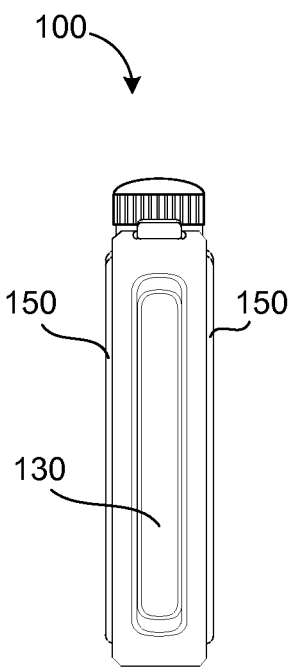
FIG. 4 is a left side view of a storage container, and associated left side panel, in accordance with a preferred exemplary embodiment of the present invention.

Referring now to FIG. 4 a left side view of a storage container 100, also depicting the left side panel of storage container 100, in accordance with a preferred embodiment of the present invention is shown. As previously explained, left side contact point 130 is a protrusion that acts as a contact surface and is sized and positioned so as to be inserted into a corresponding and cooperating indentation, depression or recess formed in the right side panel of storage container 100.

Figure 5:
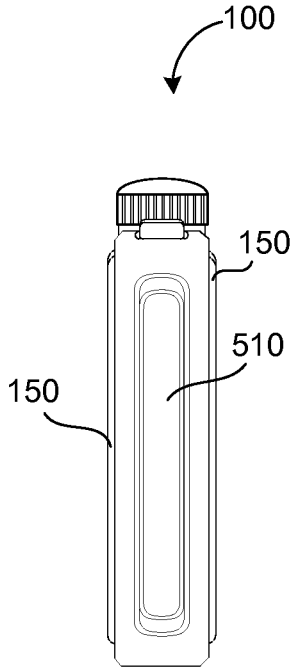
FIG. 5 is a right side view of a storage container, and associated right side panel, in accordance with a preferred exemplary embodiment of the present invention.

Referring now to FIG. 5 a right side view of a storage container 100, also depicting the right side panel of storage container 100, in accordance with a preferred embodiment of the present invention is shown. As shown in FIG. 5, an indentation, recess or depression 510 is formed in the right side panel of storage container of a storage container 100. As previously mentioned, indentation, recess or depression 510 is a contact surface that is sized and positioned so as to receive a left side contact point 130 into the interior of the space defined by indentation, recess or depression 510.

Figure 6:
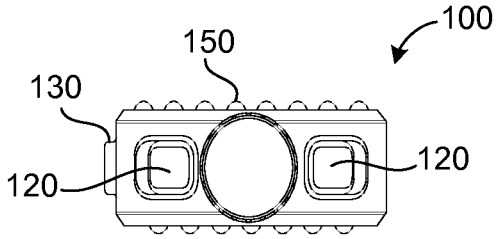
FIG. 6 is a top view of a storage container, and associated top portion, in accordance with a preferred exemplary embodiment of the present invention.

Referring now to FIG. 6 a top view of a storage container, also depicting the top portion of storage container 100, in accordance with a preferred embodiment of the present invention is shown. As shown in FIG. 6, contact points 120 are positioned substantially equidistance from the center point of cap 110.

Figure 7:
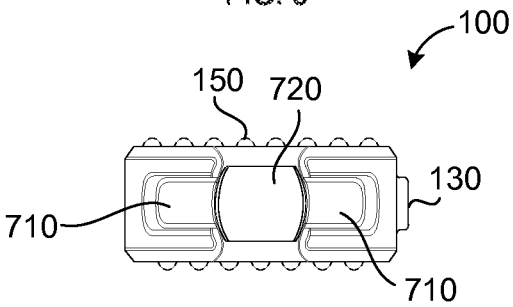
FIG. 7 is a bottom view of a storage container, and associated bottom portion, in accordance with a preferred exemplary embodiment of the present invention.

Referring now to FIG. 7, a bottom view of a storage container 100, also depicting the bottom portion of storage container 100, in accordance with a preferred embodiment of the present invention is shown. As shown in FIG. 7, the bottom portion of storage container 100 comprises a contact surface with a pair of recesses or depressions 710. Recesses or depressions 710 of a first storage container 100 are sized and positioned so as to receive contact points 120 of a second storage container 100 when the second storage container 100 is stacked on top of the first storage container 100. Additionally, the bottom portion of storage container 100 comprises a recess 720 which is sized and positioned to provide for clearance of the cap 110 of a storage container 100 when multiple storage containers 100 are stacked in a vertical configuration as shown in FIG. 8.

Figure 8:
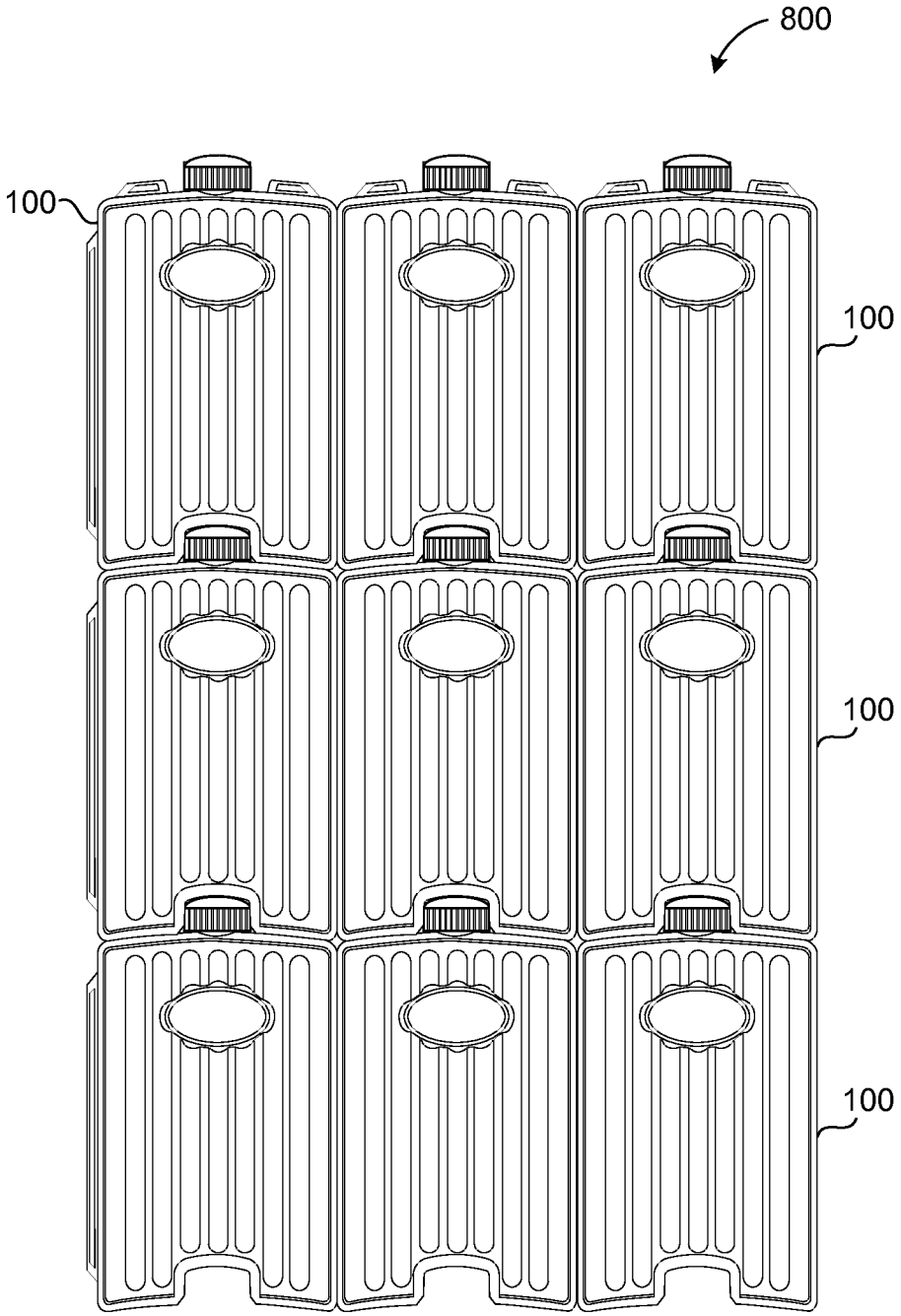
FIG. 8 is a front view of a wall-like storage configuration using a plurality of storage containers in accordance with a preferred exemplary embodiment of the present invention.

Referring now to FIG. 8 a front view of a wall-like storage configuration 800 using a plurality of storage containers in accordance with a preferred embodiment of the present invention is shown. As shown in FIG. 8, a plurality of storage containers 100 have been stacked up and positioned side by side to form a "wall" of storage containers 100. Storage configuration 800 is especially useful for situations where there is a narrow space for storage where more traditional storage devices are not compatible (e.g., behind a sofa or loveseat or against the wall in the garage. Since each storage unit 100 has a plurality of contact surfaces engaging the contact surface of at least two other storage containers 100, the stability of storage configuration 800 is significantly enhanced when compared to conventional storage options that do not employ the contact surfaces of the present invention.

Figure 9:
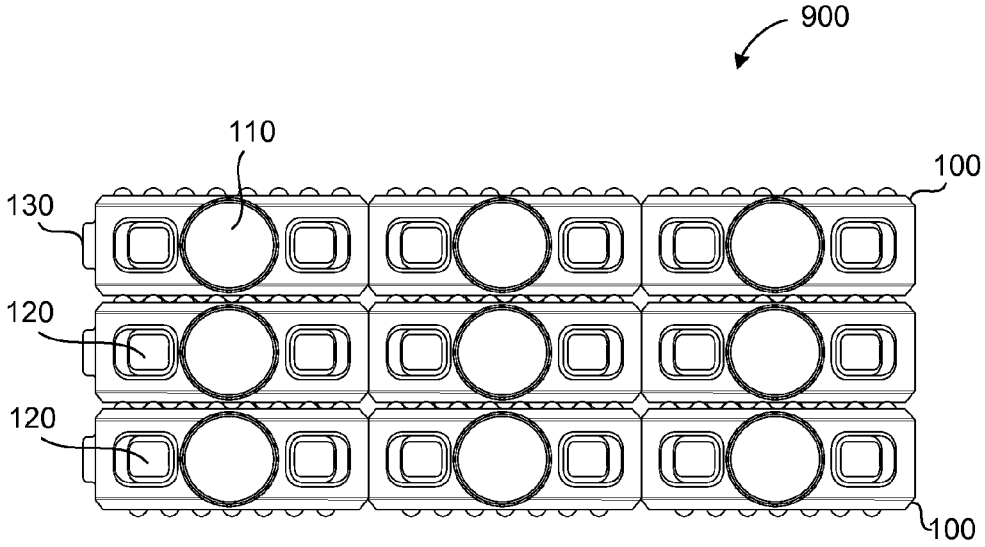
FIG. 9 is a top view of an alternative storage configuration using a plurality of storage containers in accordance with a preferred exemplary embodiment of the present invention.

Referring now to FIG. 9 a top view of an alternative storage configuration 900 using a plurality of storage containers in accordance with a preferred embodiment of the present invention is shown. As shown in FIG. 9, a plurality of storage containers 100 have been positioned in a 3×3 rectangular configuration. In this fashion, the maximum amount of storage can be obtained while simultaneously providing for a stable and secure storage arrangement. Storage configuration 900 is stabilized by the plurality of contact points that serve to "interlock" the body of one storage container 100 with the body of the adjacent storage container.

The reason for the difference in the number of ribs 150 on the front panel and the back panel of storage container 100 is to provide for the "nesting" of multiple storage containers 100. Ribs 150 on front panel of storage container 100 will be offset from ribs 150 on the back panel of storage container 100. As shown in FIG. 9, ribs 150 on the front panel of a first storage container 100 will "nestle" or fit in between ribs 150 of the back panel of a second, neighboring, storage containers 100. The wavy or corrugated surfaces of the front panels and the back panels limit the lateral mobility of the storage containers 100 and provides a contact surface between the two storage containers 100, enhancing the overall stability of storage configuration 900.

Similarly, the contact points 120 of a first storage container 100 will "nest" inside the interior space of the corresponding recessions or depressions 710 of a second storage container 100 that is stacked onto the top of the first storage container 100. This arrangement will further serve to limit the lateral mobility of the storage containers 100 and provides a contact surface between the two storage containers 100, enhancing the overall stability of storage configuration 800. Additionally, the weight of the materials contained in second storage container 100 that is stacked onto the top of the first storage container will serve to keep contact points 120 firmly positioned inside corresponding recessions or depressions 710.

Those skilled in the art will recognize the storage configuration 800 and storage configuration 900 can be combined in various combinations to allow for the most appropriate storage solution for a given storage space. For example, multiple wall configurations in the form of storage configuration 800 can be placed front to back, forming a thicker wall of storage containers 100. Similarly, multiple storage configurations 900 can stacked on top of each other, form various cubic or cuboid storage configuration. This allows for the use of storage containers 100 in a variety of storage locations.

For example, it is anticipated that a storage configuration similar to storage configuration 800 of FIG. 8 (e.g., a "wall" of storage containers 100) could be used to store items behind a sofa, loveseat, or other piece of furniture. Since each storage container is an independent entity, the storage wall can be made as large or small as practicable, by selecting and positioning the storage containers 100 as desired. Additionally, the combination of multiple contact surfaces and contact points on each storage container 100 allows for enhanced stability of the wall, relative to other storage solutions.

In at least one preferred embodiment of the present invention, the overall physical specifications of storage container 100 will provide for storage of approximately 1 gallon, with an height of 13 inches, being 9 inches wide, and with a depth of approximately 2.5 inches from the front to the back. In a preferred embodiment of the invention, ribs 150 have a height of approximately 0.3 inches. The thickness of the walls for storage container 100 will be determined by the nature of the prospective contents as well as the probable height of the stack of storage containers 100 to be stored in a vertical storage configuration as shown in FIG. 9. Obviously, the heavier the materials stored in storage containers 100 and the higher the "wall," the thicker the walls of storage container 100 will need to be so as to retain structural integrity. The thickness could range from ⅛ of an inch to ½ inch or more. The thickness of the wall can be varied in accordance with the proposed vertical stacking arrangement. As the vertical stacking arrangement of the container is configured at a higher level, the wall thickness of the container may be increased to provide additional structural support.

From the foregoing description, it should be appreciated that an effective and efficient storage solution is provided by the various preferred embodiments of the storage containers of the present invention and that the various preferred embodiments offer significant benefits that would be apparent to one skilled in the art. Furthermore, while multiple preferred embodiments have been presented in the foregoing description, it should be appreciated that a vast number of variations in the embodiments exist. Furthermore, while multiple preferred embodiments have been presented in the foregoing description, it should be appreciated that a vast number of variations in the embodiments exist.

For example, it should be noted that the exact dimensions and size of the storage containers of the present invention as well as the shape of the various contact surfaces described herein in not described so as to limit the preferred embodiments of the invention but provided as exemplary representations for use by those skilled in the art. Other shapes and locations may be selected, the number of contact surfaces and number of ribs, contact points, etc. may be varied as desired and/or necessary for a specific application.

Accordingly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. An apparatus comprising a substantially rectangular cuboid body and a cap, the body comprising:

a front panel, the front panel comprising a contact surface with at least one substantially vertical protrusion;

a back panel, the back panel comprising a contact surface with at least one substantially vertical protrusion, wherein the at least one substantially vertical protrusion of the front panel is designed to be inserted into a cooperating substantially vertical indention formed in the back panel and the at least one substantially vertical protrusion of the back panel is designed to be inserted into a cooperating substantially vertical indention formed in the front panel;

a left side panel, the left side panel comprising a contact surface with at least one substantially vertical protrusion;

a right side panel, the right side panel comprising a contact surface with at least one substantially vertical indention, wherein the at least one substantially vertical protrusion of the left side panel is designed to be inserted into the at least one substantially vertical indention in the right side panel;

a top portion, the top portion comprising a contact surface;

a bottom portion, the bottom portion comprising a contact surface; and a branding surface formed in at least one of the front panel and the back panel and wherein the branding surface interrupts the continuity of the at least one substantially vertical protrusion formed in at least one of the front panel and the back panel and wherein the at least one substantially vertical protrusion comprises a plurality of parallel substantially vertical protrusions formed in the front panel and a plurality of parallel substantially vertical protrusions formed in the back panel.

2. The apparatus of claim 1 wherein the cap comprises an internally threaded cap.

3. The apparatus of claim 1 wherein the apparatus and the cap are manufactured from a food grade plastic.

4. The apparatus of claim 1 wherein the apparatus comprises one of an opaque or semi-opaque food grade plastic.

5. The apparatus of claim 1 wherein the contact surface of the front panel comprises an even number of substantially vertical ribs and wherein the contact surface of the back panel comprises an odd number of substantially vertical ribs.

6. The apparatus of claim 1 wherein the contact surface of the left side panel comprises at least one raised frusto-pyramidal shape and wherein the contact surface of the right side panel comprises at least one recessed frusto-pyramidal shape, wherein the at least one raised shape is sized so as to fit into the at least one recessed shape.

7. The apparatus of claim 1 wherein the contact surface of the top portion comprises at least one raised shape and wherein the contact surface of the bottom portion comprises at least one recessed shape, wherein the at least one raised shape is sized so as to fit into the at least one recessed shape.

8. The apparatus of claim 7 wherein the at least one raised shape of the top portion comprises a substantially frusto-pyramidal shape and the at least one recessed shape of the bottom portion comprises a substantially frusto-pyramidal shape.

9. A substantially rectangular cuboid storage container manufactured from a substantially opaque food grade plastic comprising:

an externally threaded neck portion; an internally threaded cap, the internally threaded cap being removably screwed onto the externally threaded neck portion;

a front panel, the front panel comprising an even number of substantially vertical ribs;

a back panel, the back panel comprising an odd number of substantially vertical ribs wherein the even number of substantially vertical ribs are designed to be inserted into cooperating indentions formed on the back panel and the odd number of substantially vertical ribs are designed to be inserted into cooperating indentions formed on the front panel;

a left side panel, the left side panel comprising a raised substantially rounded frusto-pyramidal shape;

a right side panel, the right side panel comprising a recessed substantially rounded frusto-pyramidal shape, wherein the raised substantially rounded frusto-pyramidal shape on the left side panel is sized so as to fit into the recessed substantially rounded frusto-pyramidal shape on the right side panel;

a top portion, the top portion comprising a pair of substantially rounded frusto-pyramidal raised shapes;

a bottom portion, the bottom portion comprising a pair of substantially rounded frusto-pyramidal recessed shapes; and a branding surface formed in the front panel wherein the branding surface interrupts the continuity of the substantially vertical ribs formed in the front panel and wherein the substantially vertical ribs comprises a plurality of parallel substantially vertical ribs formed in the front panel.

10. A method comprising the steps of:

storing a first substantially rectangular cuboid storage container in a desired location; and storing a second substantially rectangular cuboid storage container in the desired location, where each of the first storage container and the second storage container comprises:

a front panel, the front panel comprising a contact surface with at least one protrusion;

a back panel, the back panel comprising a contact surface with at least one protrusion, wherein the at least one protrusion of the front panel is designed to be inserted into a cooperating indention formed in the back panel and the at least one protrusion of the back panel is designed to be inserted into a cooperating indention formed in the front panel;

a left side panel, the left side panel comprising a contact surface;

a right side panel, the right side panel comprising a contact surface with at least one indention, wherein at least one protrusion of the left side panel is designed to be inserted into the at least one indention in the right side panel;

a top portion, the top portion comprising a contact surface;

a bottom portion, the bottom portion comprising a contact surface; and wherein each of the first storage container and the second storage container further comprises a branding surface formed in at least one of the front panel and the back panel and wherein the branding surface interrupts the continuity of the at least one protrusion formed in at least one of the front panel and the back panel.

11. The method of claim 10 further comprising the step of removably screwing a internally threaded cap onto an externally threaded neck on at least one of the first storage container or the second storage container.

12. The method of claim 10 wherein the first storage container and the second storage container are manufactured from a food grade plastic.

13. The method of claim 10 wherein the first storage container and the second storage container comprise at least one of an opaque or semi-opaque food grade plastic.

14. The method of claim 10 wherein the contact surface of the front panel comprises an even number of substantially vertical ribs and wherein the contact surface of the back panel comprises an odd number of substantially vertical ribs.

15. The method of claim 10 wherein the raised shape of the left side panel comprises a substantially frusto-pyramidal shape and the recessed shape of the right side panel comprises a substantially frusto-pyramidal shape.

16. The method of claim 10 wherein the contact surface of the top portion comprises at least one raised shape and wherein the contact surface of the bottom portion comprises a recessed shape, wherein the raised shape is sized so as to fit into the recessed shape.

17. The method of claim 16 wherein the raised shape of the top portion comprises a substantially frusto-pyramidal shape and the recessed shape of the bottom portion comprises a substantially frusto-pyramidal shape.

18. The method of claim 10 further comprising the step of arranging an additional plurality of storage containers to create a storage configuration.

* * * * *